United States Patent [19]

Iimura et al.

[11] Patent Number: 4,981,457

[45] Date of Patent: Jan. 1, 1991

[54] TOY MUSICAL INSTRUMENTS

[75] Inventors: Taichi Iimura; Nobuyuki Kiyota, both of Tokyo, Japan

[73] Assignee: Tomy Company, Ltd., Tokyo, Japan

[21] Appl. No.: 407,670

[22] Filed: Sep. 14, 1989

[30] Foreign Application Priority Data

Sep. 16, 1988 [JP] Japan ..... 63-121459[U]

[51] Int. Cl.[5] ..... A63H 5/00

[52] U.S. Cl. ..... 446/408; 84/609; 84/626

[58] Field of Search ..... 446/408, 397, 297; 84/609–614, 634–638, DIG. 7, 626, 627

[56] References Cited

U.S. PATENT DOCUMENTS 3,808,733 5/1974 Pipa ..... 446/408
4,756,222 7/1988 Armato ..... 446/397 X

FOREIGN PATENT DOCUMENTS 2091020A 7/1982 United Kingdom .
2091470A 7/1982 United Kingdom .
2148575A 5/1985 United Kingdom .

*Primary Examiner*—Mickey Yu
*Attorney, Agent, or Firm*—Staas & Halsey

[57] ABSTRACT

A toy musical instrument has a microprocessor which records in memory a plurality of songs. A moveable part of the toy musical instrument is used to open and close a sound switch so that the next note of each song is played with each closing of the sound switch. The length of each note is determined by the length of time that the sound switch is closed, and the interval between notes is determined by the interval between closings of the sound switch.

18 Claims, 4 Drawing Sheets

FIG. 3
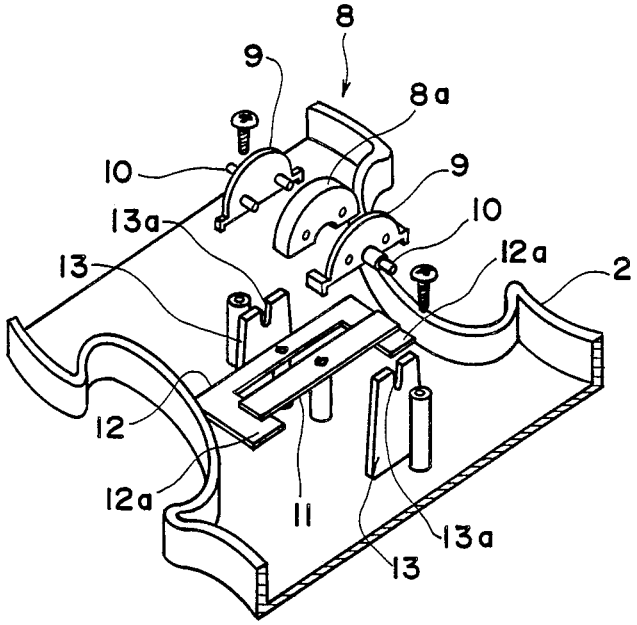
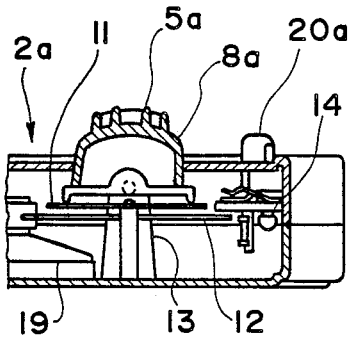
FIG. 5
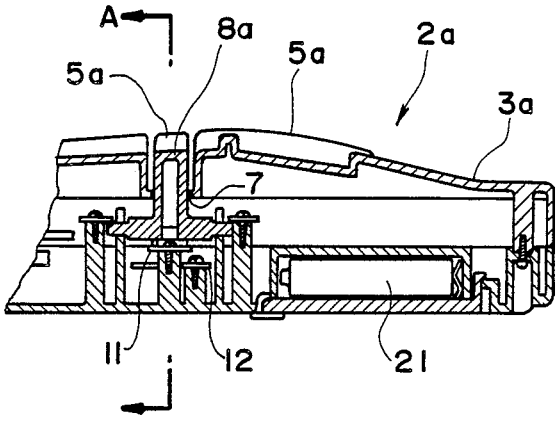
FIG. 4

TOY MUSICAL INSTRUMENTS

BACKGROUND OF THE INVENTION

1. Field of the Invention

The present invention relates generally to amusement devices and, more specifically, to toys which emulate the playing of musical instruments.

2. Description of the Related Art

It has been known to provide a musical toy having a hand operated music box. Music is created by using a plurality of diaphragms with, for example, a keyboard of a play piano.

The toy musical instrument as described above is capable of performing a preset pattern of music notes at the correct interval, but has the disadvantage that the melody cannot be performed because the sound length cannot be controlled.

SUMMARY OF THE INVENTION

An object of the present invention is to provide a toy musical instrument which is capable of emulating the playing of a real musical instrument.

Another object of the present invention is to provide a toy musical instrument which is capable of allowing the player to vary the sound length.

Another object of the present invention is to provide a toy musical instrument in which the interval between notes of a song is varied by the player in accordance with the open time of a switch.

These and other objects of the invention are met by providing a toy musical instrument which includes a body having a moveable part for manipulation by a player, memory means for storing at least one song, a normally open sound switch closeable by the moveable part of the body when manipulated by the player, and a sound generating mechanism including a speaker, wherein an interval between notes of the at least one song is coincident with an interval between times when the sound switch is open.

These and other features and advantages of the toy musical instrument of the present invention will become more apparent with reference to the following detailed description and drawings.

BRIEF DESCRIPTION OF THE DRAWINGS

FIG. 3 is a detailed view of a portion of the embodiment of FIG. 1;

FIG. 4 is a transverse vertical, sectional view of the embodiment of FIG. 1;

FIG. 5 is a partial vertical sectional view showing in principle the embodiment of FIG. 1;

DETAILED DESCRIPTION OF THE PREFERRED EMBODIMENTS

Figure 1:
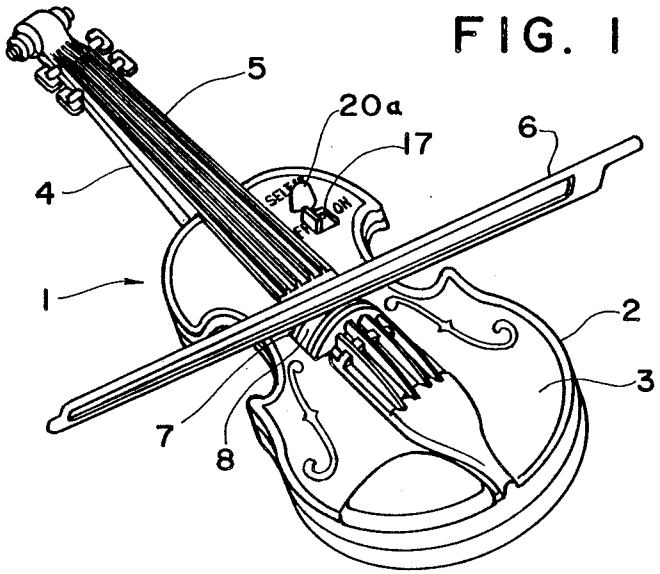
FIG. 1 is a perspective view of a first, preferred embodiment of the present invention.
Figure 2:
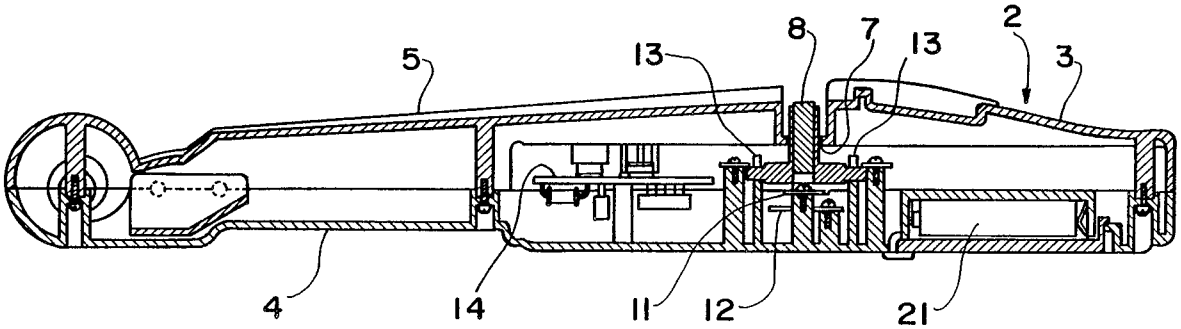
FIG. 2 is a longitudinal, vertical sectional view of the embodiment of FIG. 2.
Figure 6:
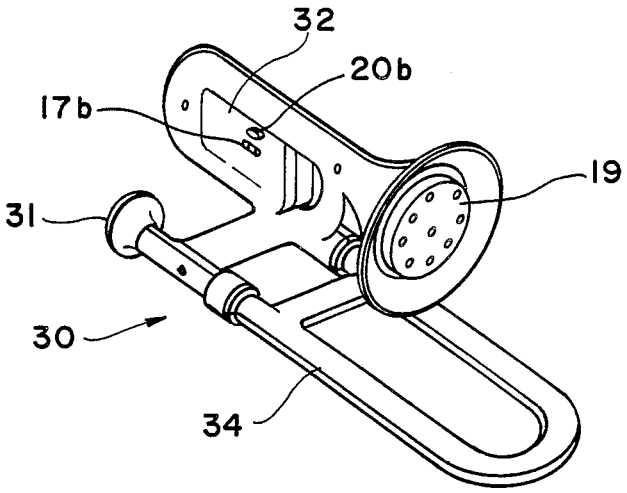
FIG. 6 is a perspective view of a second, preferred embodiment of the present invention.
Figure 7:
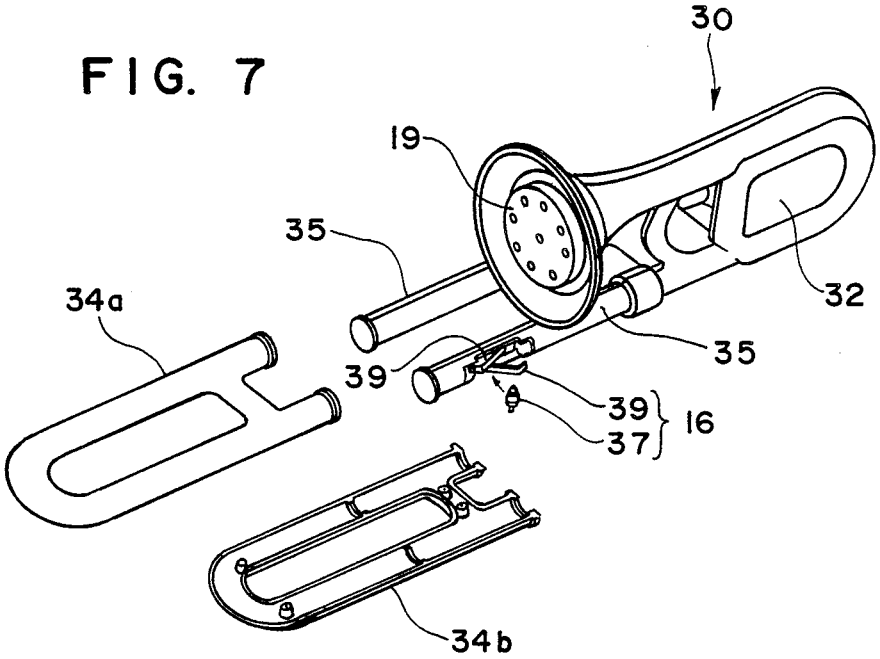
FIG. 7 is a partial exploded view of the embodiment of FIG. 6.
Figure 8:
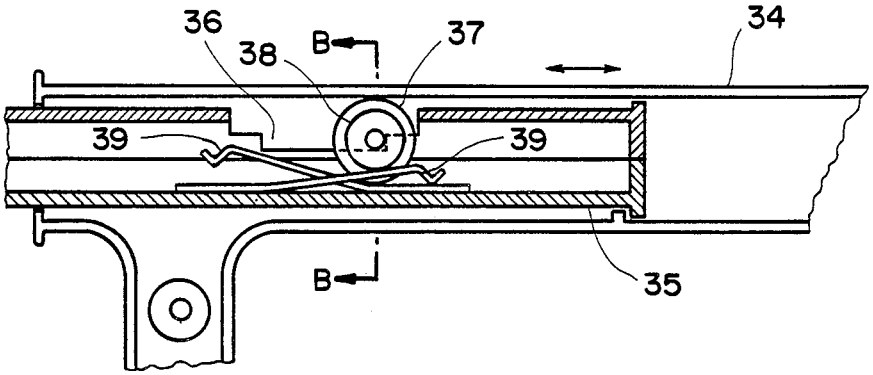
FIG. 8 is a detailed sectional view, partially cut away, of the embodiment of FIG. 6.
Figure 9:
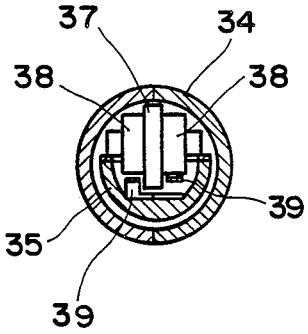
FIG. 9 is a sectional view taken along line B—B of FIG. 8.

Referring to FIGS. 1–5, a body 1 has the shape of a musical instrument, such as a violin, which includes a base portion 2 and a neck portion 4. The body 1 is integrally formed by molding synthetic resin, and preferably, the body 1 is made in two shell halves which are joined along the periphery thereof. The interior of the body 1 is hollow for holding the components which will be described below.

A plurality of projections 5 are provided along the neck portion 4 to imitate the strings of the violin. The projections are formed along the center of the front board 3 of the base portion 2 and the neck portion 4.

A power ON-OFF switch 17 is provided on the front board 3 and extends into the interior for connection with a circuit board, to be described below. A separate switch 20 is provided near the power switch 17 for selecting one of a plurality of songs recorded in memory.

A space is provided between the projections 5 formed on the front board 3, in which an opening 7 is formed. A moveable part 8 is rotatably mounted in the interior of the body 1, and projects upwardly through the opening for reciprocating back and forth in response to a player's movement of a playing stick or bow 6. The bow 6 emulates playing of a violin by frictionally engaging the arcuate surface of the moveable part 7. When actuated by the bow 6, the moveable part 8, contacts a certain portion of the musical instrument to open and close a circuit which causes music to be played by a speaker (to be described below).

In one embodiment, the moveable part 8 is made of a central, semi-circular disk 8A and two side plates 9 which sandwich the disk 8A therebetween. The side plates 9 have supporting shafts 10 for rotatably mounting the moveable part inside the body 1 onto vertical supports 13, each having a notch 13A in the upper end thereof for receiving the shafts 10. Projections are performed at opposite sides of the moveable part 8. A conductive contact plate 11 is mounted under the projections of the moveable part 8 so that each of the opposite ends of the contact plate can be deflected downwardly, depending on the direction of rotation of the moveable part 8. A U-shaped conductive contact plate 12 is mounted under the contact plate 11 so that when the ends of the contact plate 11 are deflected downwardly, they contact either side of the U-shaped contact plate 12. Thus, an electrical contact is made, and a switch closed, when the moveable part 8 is moved to cause contact at the sides 12a cf the U-shaped conductive contact plate 12.

A printed circuit board 14 is provided with an integrated circuit or computer chip 15 which has stored in memory a plurality of songs, each having a certain order of notes constituting a melody. The computer chip 15 is a large scale integrated circuit having an interval of songs which can be played in a certain order. A control button 20A is provided for selecting a song from the plurality of songs.

Figure 10:
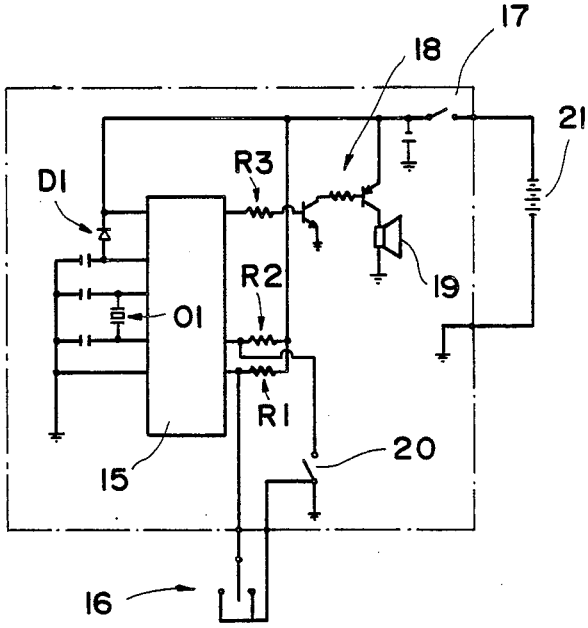
FIG. 10 is a wiring diagram applicable to either of the first or second embodiments of the present invention.

Referring to FIG. 10 the circuit which enables the toy musical instrument to play music includes the computer chip 15, which acts as a microcomputer or a central processing unit (CPU). A speaker 19 is connected through an amplifier 18 to the computer chip 15. The speaker 19 sounds through the body of the toy musical instrument through a plurality of holes formed over the speaker, which is mounted within the body. A battery 21 powers the circuit and drives the speaker.

A sound switch 16 shown in FIG. 10 has two contacts and a throw which moves between the two contacts. The sound switch 16 presents the reciprocating movement of the conductive contact plate 11 as it touches the U-shaped conductive contact plate 12, in response to movement by the player of the playing stick 6.

The computer chip 15 is programmed to sound a certain musical interval when the conductive contact plates 11 and 12 are contacted together. When the conductive contact plates 11 and 12 are separated, the sound switch 16 is in an open condition and sound is stopped. When the conductive contact plates are recontacted, the next note of the song recorded in memory is played. Therefore, the length of the note to be sounded can be modulated, so that the length of time between notes and the length that each note is played are varied according to the players manipulation of the playing stick 6. Thus, the melody can be easily performed.

FIGS. 4 and 5 show another embodiment where a guitar is emulated by the toy musical instrument. The toy has essentially the same features as the embodiment of FIGS. 1–3, except that the moveable part 8 is integrally formed as one piece and is provided with string shaped projections 5A on an upper, arcuate surface thereof. Also, the opening 7 is provided in a position which more accurately corresponds to the position where the strings of a real guitar are played by a player, i.e. further back on the body. The moveable part 8 is manipulated by the players fingers in a manner that emulates the playing of a guitar. The lower portion of the moveable part 8 pushes a conductive contact plate 11 into contact with a lower conductive contact plate 12. As in the previously-described embodiment, a printed circuit board 14 is provided with a computer chip 15 having control means for sounding predetermined musical intervals in a certain order. The circuitry provided in the embodiment of FIGS. 4 and 5 is essentially the same as that which is illustrated in FIG. 10.

A third embodiment, which emulates a trombone, is described with reference to FIGS. 6–9. The main body 30 is shaped to emulate a trombone, and includes a mouthpiece 31 at one end. A speaker 19 is formed in a place where normally sound would emanate from a trombone. A slide tube 34 is provided on an intermediate portion of the body 1, and is formed as two shell halves 34A and 34B which are screwed together. The slide tube 34 is mounted on stationary tubes 35, which are provide with headed end portions to keep the slide tube 34 from sliding off the supporting tubes 35.

A frame 32 is formed on a main part of the body, so as to house the computer chip or microcomputer 15, which has the same function as that which was described for the first two embodiments. A power switch 17B and a select switch 20B are used for selecting the music program and turning on the toy musical device.

The sound switch 16 is formed in the side of one of the supporting tubes 35. A roller 37 is rotatably mounted in a concave portion 36 of the tube 35. The roller 37 has opposite side cylindrical surfaces 38 which contact conductive contact plates 39 disposed in the supporting tube 35. The roller 37 moves back and forth in the concave portion 36 as the slide tube 34 is manipulated by the player, thus causing the cylindrical portions 38 to alternately contact the two contact plates 39, thereby opening and closing the sound switch 16. When the roller 37 is placed in the center of the concave portion 36, the contact plates 39 are separated, and the switch is opened. As the slide tube 34 is manipulated back and forth, a predetermined musical interval can be played. The length of each note is determined by the length of time that each contact 39 is depressed into electrical contact, and the length of time between those is determined by how quickly the slide tube 34 is moved in the opposite direction to contact the opposite contact plate 39.

It is clear from the foregoing that other embodiments may envision the emulation of other musical instruments, in which a moveable part is manipulated to open and close a sound switch.

With respect to the circuitry of FIG. 10, the circuitry applies to each embodiment described herein. The computer chip 15 is a microprocessor or large scale integrated circuit, such as model no. M6411A-59V by Oki of Japan. The circuit includes resistors R1, R2, and R3, a diode D1 and an oscillator 01. The oscillator is preferably 4 MHz.

Numerous modifications and adaptations of the present invention will be apparent to those so skilled in the art and thus, it is intended by the following claims to cover all such modifications and adaptations which fall within the true spirit and scope of the invention.

We claim:

1. A toy musical instrument comprising:

a body having a part for manipulation by a player:

memory means storing at least one song having a plurality of notes to be played in succession;

a normally open sound switch closeable by the movable part of the body when manipulated by the player; and a sound generating mechanism including a speaker, wherein an interval between successive notes of the at least one song is determined by an interval between successive closings of the sound switch, a duration of each note being determined by a duration for which the switch is closed.

2. A toy musical instrument as claimed in claim 1 wherein the sound generating mechanism includes a microprocessor which has the memory means for storing the at least one song.

3. A toy musical instrument according to claim 2, wherein the microprocessor is included in an electronic circuit which incorporates the normally open sound switch.

4. A toy musical instrument according to claim 1 wherein the normally open sound switch includes a first conductive contact plate having opposite end portions and a second conductive contact plate mounted above the first conductive contact plate and having opposite ends which overlie the opposite ends of the first conductive contact plate.

5. A toy musical instrument according to claim 4, wherein the moveable part of the body is rotatably mounted to the body for rocking about an axis medial to the first and second conductive contact plates so that when the moveable part is rotated back and forth, opposite ends of the moveable part push the second conductive contact plate into electrical contact with the first conductive contact plate, alternatively at opposite ends thereof, to open and close the sound switch.

6. A toy musical instrument according to claim 5, further comprising a bow for manipulating the moveable part.

7. A toy musical instrument according to claim 1, wherein the body is shaped in the form of a violin having a neck and base, and a plurality of strings are formed in the neck and base as raised projections on an upper surface of the neck and base, the base including an opening formed in an area of the raised projections, the moveable part being mounted in the body and extending outwardly through the opening and having an outer surface which follows the contour of the raised projections.

8. A toy musical instrument as claimed in claim 1 further comprising an electronic circuit which includes the normally open sound switch, a selector switch for selecting one of a plurality of songs, and a power switch for selectively turning on and off a power supply.

9. A toy musical instrument according to claim 1 wherein the moveable part is a sliding tube slidably mounted on a support tube.

10. A toy musical instrument according to claim 9, wherein the normally open sound switch includes two conductive contact plates mounted on the support tube and a roller rotatably and slidably mounted in the slide tube for movement over the two contact plates.

11. A toy musical instrument according to claim 10, wherein the two conductive contacts plates have end portions which overlie opposite end portions of each other by crossing at a medial portion thereof, wherein at the point of crossing, the switch is open and the switch is closed by moving the roller over the two conductive contact plates in opposite directions from the point of crossing.

12. A toy musical instrument according to claim 9, wherein the body is in the shape of a trombone and the moveable part is a slide of the trombone.

13. A toy musical instrument according to claim 12, wherein the speaker is disposed in a horn of the trombone.

14. A toy musical instrument according to claim 9 further comprising an electronic circuit which includes the normally open sound switch, a selector switch for selecting one of a plurality of songs, and a power switch for selectively turning on and off a power supply.

15. A toy musical instrument according to claim 14 wherein the sound generating mechanism includes a microprocessor which is incorporated into the electronic circuit.

16. A toy musical instrument comprising:

a body having a movable part for manipulation by a player;

memory means storing at least one song having a plurality of notes to be played in succession;

a normally open sound switch closeable by the movable part of the body when manipulated by the player; and a sound generating mechanism including a speaker, wherein an interval between successive notes of the at least one song is determined by an interval between successive closings of the sound switch, wherein the normally open sound switch includes a first conductive contact plate having opposite end portions and a second conductive contact plate mounted above the first conductive contact plate and having opposite ends which overlie the opposite ends of the first conductive contact plate, and wherein the movable part of the body is rotatably mounted to the body for rocking about an axis medial to the first and second conductive contact plates so that when the movable part is rotated back and forth, opposite ends of the movable part push the second conductive contact plate into electrical contact with the first conductive contact plate, alternatively at opposite ends thereof, to open and close the sound switch.

17. A toy musical instrument comprising:

a body having a movable part for manipulation by a player;

memory means storing at least one song having a plurality of notes to be played in succession;

a normally open sound switch closeable by the movable part of the body when manipulated by the player; and a sound generating mechanism including a speaker, wherein an interval between notes of the at least one song is determined by an interval between successive closings of the sound switch, wherein the body is shaped in the form of a violin having a neck and base, and a plurality of strings are formed in the neck and base as raised projections on an upper surface of the neck and base, the base including an opening formed in an area of the raised projections, the movable part being mounted in the body and extending outwardly through the opening and having an outer surface which follows the contour of the raised projections.

18. A toy musical instrument comprising:

a body having a movable part for manipulation by a player;

memory means storing at least one song having a plurality of notes to be played in succession;

a normally open sound switch closeable by the movable part of the body when manipulated by the player; and a sound generating mechanism including a speaker, wherein an interval between notes of the at least one song is determined by an interval between successive closings of the sound switch, wherein the movable part is a sliding tube slidably mounted on a support tube, and wherein the normally open sound switch includes two conductive contact plates mounted on the support tube and a roller rotatably and slidably mounted in the slide tube for movement over the two contact plates.

* * * * *

UNITED STATES PATENT AND TRADEMARK OFFICE

CERTIFICATE OF CORRECTION

PATENT NO. : 4,981,457

DATED : January 1, 1991

INVENTOR(S) : Taichi Iimura et al.

It is certified that error appears in the above-identified patent and that said Letters Patent is hereby corrected as shown below:

Col. 4, line 30, before "part" insert --movable--.

Signed and Sealed this

Twenty-eighth Day of July, 1992

*Attest:*

DOUGLAS B. COMER

*Attesting Officer*

*Acting Commissioner of Patents and Trademarks*